US011127344B2

(12) United States Patent
Zhao et al.

(10) Patent No.: US 11,127,344 B2
(45) Date of Patent: Sep. 21, 2021

(54) METHOD AND DEVICE FOR DRIVING DISPLAY PANEL AND DISPLAY DEVICE

(71) Applicants: HEFEI BOE DISPLAY TECHNOLOGY CO., LTD., Anhui (CN); BOE TECHNOLOGY GROUP CO., LTD., Beijing (CN)

(72) Inventors: Peng Zhao, Beijing (CN); Bin Li, Beijing (CN); Xiuqin Yang, Beijing (CN); Huiming Wang, Beijing (CN); Jing Ma, Beijing (CN); Rongcheng Liu, Beijing (CN); Min Wang, Beijing (CN); Qing Lei, Beijing (CN); Jinbo Xu, Beijing (CN)

(73) Assignees: HEFEI BOE DISPLAY TECHNOLOGY CO., LTD., Anhui (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/901,253

(22) Filed: Jun. 15, 2020

(65) Prior Publication Data

US 2021/0193023 A1 Jun. 24, 2021

(30) Foreign Application Priority Data

Dec. 20, 2019 (CN) ..... 201911323774.7

(51) Int. Cl.
*G09G 3/32* (2016.01)

(52) U.S. Cl.
CPC ..... *G09G 3/32* (2013.01); *G09G 2300/0408* (2013.01); *G09G 2310/0267* (2013.01); *G09G 2310/08* (2013.01); *G09G 2370/04* (2013.01)

(58) Field of Classification Search
CPC ..... G09G 3/32; G09G 2300/0408; G09G 2310/0267; G09G 2370/04; G09G 2310/08
See application file for complete search history.

(56) References Cited

U.S. PATENT DOCUMENTS

2013/0278567 A1* 10/2013 Chang ..... G06F 30/394 345/204
2014/0198023 A1* 7/2014 Hsu ..... G09G 3/3674 345/99
2017/0255315 A1* 9/2017 Lin ..... G06F 3/04166
(Continued)

*Primary Examiner* — Muhammad N Edun
(74) *Attorney, Agent, or Firm* — Muncy, Geissler, Olds & Lowe, P.C.

(57) ABSTRACT

A method for driving a display panel, a device for driving a display panel and a display device are provided. The method for driving a display panel includes: acquiring a GOA signal corresponding to a current frame of image, where the GOA signal includes a plurality of clock signals; determining a transmission channel corresponding to each of the plurality of clock signals, and generating a correspondence relationship between the clock signals and respective transmission channels, where the transmission channels are used to deliver the clock signals from a GOA control signal generator to a GOA circuit of the display panel, the current frame of image is different from at least one frame of image previous to the current frame of image with respect to the correspondence relationship between the clock signals and respective transmission channels; and transmitting the clock signals by using the determined transmission channels.

17 Claims, 7 Drawing Sheets

(56) References Cited

U.S. PATENT DOCUMENTS

| | | | | |
|---|---|---|---|---|
| 2018/0233098 | A1* | 8/2018 | Du | G02F 1/13306 |
| 2019/0057668 | A1* | 2/2019 | Xiong | G09G 3/3696 |
| 2019/0139496 | A1* | 5/2019 | Peng | G09G 3/342 |
| 2020/0168175 | A1* | 5/2020 | Tsuchi | G09G 3/2096 |

* cited by examiner

METHOD AND DEVICE FOR DRIVING DISPLAY PANEL AND DISPLAY DEVICE

CROSS-REFERENCE TO RELATED APPLICATION

This application claims a priority to Chinese Patent Application No. 201911323774.7 filed in China on Dec. 20, 2019, the disclosure of which is incorporated herein in its entirety by reference.

TECHNICAL FIELD

The present disclosure relates to the field of display technologies, in particular to a method for driving a display panel, a device for driving a display panel and a display device.

BACKGROUND

In a display panel of the related art, a clock signal (CLK) in a Gate Driver on Array (or Gate on Array, GOA) signal is generally used to generate a line driving signal (G-out), to control a thin film transistor (TFT) of each pixel to be turned on or off.

SUMMARY

In a first aspect, a method for driving a display panel is provided in embodiments of the present disclosure, including:

acquiring a gate driver on array (GOA) signal corresponding to a current frame of image, where the GOA signal includes a plurality of clock signals;

determining a transmission channel corresponding to each of the plurality of clock signals, and generating a correspondence relationship between the clock signals and respective transmission channels, where the transmission channels are used to deliver the clock signals from a GOA control signal generator to a GOA circuit of the display panel, the current frame of image is different from at least one frame of image previous to the current frame of image with respect to the correspondence relationship between the clock signals and respective transmission channels; and transmitting the clock signals by using the determined transmission channels.

Optionally, the determining the transmission channel corresponding to each of the plurality of clock signals, and generating the correspondence relationship between the clock signals and respective transmission channels includes:

generating a random number corresponding to each frame of image, and determining the transmission channel corresponding to each of the plurality of clock signals based on the generated random number, and generating the correspondence relationship between the clock signals and respective transmission channels.

Optionally, both a quantity of the transmission channels and a quantity of the clock signals are M, M is a positive integer, and the determining the transmission channel corresponding to each of the plurality of clock signals based on the generated random number, and generating the correspondence relationship between the clock signals and respective transmission channels includes:

generating a random number N corresponding to the current frame of image, where N is a positive integer and is not greater than M;

determining that a Kth clock signal corresponds to a (K+N−1)th transmission channel in a case that K+N−1 is not greater than M; K is a positive integer and is less than or equal to M; and determining that a Kth clock signal corresponds to a (K+N−1−M)th transmission channel in a case that K+N−1 is greater than M.

Optionally, both a quantity of the transmission channels and a quantity of the clock signals are M, M is a positive integer, and the determining the transmission channel corresponding to each of the plurality of clock signals based on the generated random number, and generating the correspondence relationship between the clock signals and respective transmission channels includes:

generating a random number N corresponding to the current frame of image, where N is a positive integer and is not greater than M;

determining that a Kth transmission channel corresponds to a (K+N−1)th clock signal in a case that K+N−1 is not greater than M, where K is a positive integer and is less than or equal to M; and determining that a Kth transmission channel corresponds to a (K+N−1−M)th clock signal in a case that K+N−1 is greater than M.

Optionally, both a quantity of the transmission channels and a quantity of the clock signals are M, M is a positive integer, and the determining the transmission channel corresponding to each of the plurality of clock signals based on the generated random number, and generating the correspondence relationship between the clock signals and respective transmission channels includes:

generating a randomly arranged sequence including M random numbers that corresponds to the current frame of image;

taking the randomly arranged sequence as a first arrangement sequence corresponding to M clock signals; where M transmission channels are arranged sequentially; and determining the transmission channel corresponding to each of the M clock signals based on the first arrangement sequence and the M transmission channels arranged sequentially, and generating the correspondence relationship between the clock signals and respective transmission channels.

Optionally, both a quantity of the transmission channels and a quantity of the clock signals are M, M is a positive integer, the determining the transmission channel corresponding to each of the plurality of clock signals based on the generated random number, and generating the correspondence relationship between the clock signals and respective transmission channels includes:

generating a randomly arranged sequence including M random numbers that corresponds to the current frame of image;

taking the randomly arranged sequence as a second arrangement sequence corresponding to M transmission channels; where M clock signals are arranged sequentially; and determining the transmission channel corresponding to each of the M clock signals based on the second arrangement sequence and the M clock signals arranged sequentially, and generating the correspondence relationship between the clock signals and respective transmission channels.

Optionally, subsequent to the transmitting the clock signals by using the determined transmission channels, the method for driving the display panel further includes:

adjusting a transmission timing sequence of data signals so that the transmission timing sequence of the data signals matches a timing sequence of the clock signals, where the timing sequence of the clock signals is determined based on the correspondence relationship between the clock signals and the transmission channels.

Optionally, the adjusting the transmission timing sequence of data signals so that the transmission timing sequence of the data signals matches the timing sequence of the clock signals includes:

dividing the data signals sequentially into a plurality of groups according to the quantity of the clock signals, where a quantity of data signals in each of the plurality of groups is equal to the quantity of the clock signals; and adjusting a timing sequence of the data signals in each of the plurality of groups so that the timing sequence of the data signals in each of the plurality of groups matches the timing sequence of the clock signals.

In a second aspect, a device for driving a display panel is further provided in the embodiments of the present disclosure, including:

an acquisition circuit, configured to acquire a GOA signal corresponding to a current frame of image, where the GOA signal includes a plurality of clock signals;

a transmission channel determination circuit, configured to determine a transmission channel corresponding to each of the plurality of clock signals, and generate a correspondence relationship between the clock signals and respective transmission channels, where the transmission channels are used to deliver the clock signals from a GOA control signal generator to a GOA circuit of the display panel, the current frame of image is different from at least one frame of image previous to the current frame of image with respect to the correspondence relationship between the clock signals and respective transmission channels; and a transmission circuit, configured to transmit the clock signals by using the determined transmission channels.

Optionally, the transmission channel determination circuit is configured to: generate a random number corresponding to each frame of image, and determine the transmission channel corresponding to each of the plurality of clock signals based on the generated random number, and generate the correspondence relationship between the clock signals and respective transmission channels.

Optionally, both a quantity of the transmission channels and a quantity of the clock signals are M, M is a positive integer, and the transmission channel determination circuit includes:

a random number generation sub-circuit, configured to generate a random number N corresponding to the current frame of image, where N is a positive integer and N is not greater than M; and a transmission channel determination sub-circuit, configured to determine that a Kth clock signal corresponds to a (K+N−1)th transmission channel in a case that K+N−1 is not greater than M, where K is a positive integer and is less than or equal to M; and configured to determine that a Kth clock signal corresponds to a (K+N−1−M)th transmission channel in a case that K+N−1 is greater than M.

Optionally, both a quantity of the transmission channels and a quantity of the clock signals are M, M is a positive integer, and the transmission channel determination circuit includes:

a random number generation sub-circuit, configured to generate a random number N corresponding to the current frame of image, where N is a positive integer and N is not greater than M; and a transmission channel determination sub-circuit, configured to determine that a Kth transmission channel corresponds to a (K+N−1)th clock signal in a case that K+N−1 is not greater than M, where K is a positive integer and is less than or equal to M; and configured to determine that a Kth transmission channel corresponds to a (K+N−1−M)th clock signal in a case that K+N−1 is greater than M.

Optionally, both a quantity of the transmission channels and a quantity of the clock signals are M, M is a positive integer, and the transmission channel determination circuit includes:

a random number generation sub-circuit, configured to generate a randomly arranged sequence comprising M random numbers that corresponds to the current frame of image; and a transmission channel determination sub-circuit, configured to take the randomly arranged sequence as a first arrangement sequence corresponding to M clock signals; where M transmission channels are arranged sequentially; and configured to determine the transmission channel corresponding to each of the M clock signals based on the first arrangement sequence and the M transmission channels arranged sequentially, and generate the correspondence relationship between the clock signals and respective transmission channels.

Optionally, both a quantity of the transmission channels and a quantity of the clock signals are M, M is a positive integer, and the transmission channel determination circuit includes:

a random number generation sub-circuit, configured to generate a randomly arranged sequence comprising M random numbers that corresponds to the current frame of image; and a transmission channel determination sub-circuit, configured to take the randomly arranged sequence as a second arrangement sequence corresponding to M transmission channels; where M clock signals are arranged sequentially; and configured to determine the transmission channel corresponding to each of the M clock signals based on the second arrangement sequence and the M clock signals arranged sequentially, and generate the correspondence relationship between the clock signals and respective transmission channels.

Optionally, the device for driving the display panel further includes:

a timing sequence adjustment circuit, configured to adjust a transmission timing sequence of data signals so that the transmission timing sequence of the data signals matches a timing sequence of the clock signals, where the timing sequence of the clock signals is determined based on the correspondence relationship between the clock signals and the transmission channels.

Optionally, the timing sequence adjustment circuit includes:

a group division sub-circuit, configured to divide the data signals into a plurality of groups according to the quantity of the clock signals in sequence, where a quantity of data signals in each of the plurality of groups is equal to the quantity of the clock signals; and an adjustment sub-circuit, configured to adjust a timing sequence of the data signals in each of the plurality of groups so that the timing sequence of the data signals in each of the plurality of groups matches the timing sequence of the clock signals.

In a third aspect, a device for driving a display panel is further provided in the embodiments of the present disclosure, including: a memory and an executor, where the executor is configured to execute the following instructions stored in the memory:

acquiring a GOA signal corresponding to a current frame of image, where the GOA signal includes a plurality of clock signals;

determining a transmission channel corresponding to each of the plurality of clock signals, and generating a correspondence relationship between the clock signals and respective transmission channels, where the transmission channels are used to deliver the clock signals from a GOA control signal generator to a GOA circuit of the display panel, the current frame of image is different from at least one frame of image previous to the current frame of image with respect to the correspondence relationship between the clock signals and respective transmission channels; and transmitting the clock signals by using the determined transmission channels.

In a fourth aspect, a display device is further provided in the embodiments of the present disclosure, including a display panel and an aforementioned device for driving the display panel.

BRIEF DESCRIPTION OF THE DRAWINGS

In order to illustrate the technical solutions of the embodiments of the present disclosure in a clearer manner, the drawings desired for the embodiments of the present disclosure will be described hereinafter briefly. Obviously, the drawings in the following description merely relate to some embodiments of the present disclosure, and based on these drawings, a person skilled in the art may obtain other drawings without any creative effort.

DETAILED DESCRIPTION

Technical solutions of the embodiments of the present disclosure will be illustrated clearly and completely hereinafter with reference to the accompanying drawings of the embodiments of the present disclosure. Obviously, the embodiments described are merely a part of, rather than all of, the embodiments of the present disclosure, and based on the embodiments of the present disclosure, a person skilled in the art may, without any creative effort, obtain the other embodiments, which also fall within the scope of the present disclosure.

In a display panel of the related art, a clock signal (CLK) in a Gate Driver on Array (or Gate on Array, GOA) signal is generally used to generate a line driving signal (G-out) to control a thin film transistor (TFT) of each pixel to be turned on or off, and the used clock signal is transmitted through a specific transmission channel. Due to limitations of manufacturing process and other factors, it is difficult to maintain a consistent wiring resistance among transmission channels, which may cause a difference in generated line driving signals, and result in different degrees of turn-on of thin film transistors, and further cause a difference in charging effect on pixels in different lines, and a difference in charging rate of the pixels in different lines.

For a small-size or relatively low-quality display panel, the charging rate may usually reach 100%, so an impact is relatively small, while for a large-size, high-resolution, and high refresh rate display panel, a data transmission volume is very high, so charging time is relatively short, the charging rate is relatively low, and it is difficult for the charging rate to reach 100%. In this case, the impact of the wiring resistance difference of transmission channels of clock signals also increases, periodic horizontal stripes may possibly be generated, thereby degrading a display effect.

In view of the above technical problems, a method for driving a display panel, a device for driving a display panel and a display device are provided in the embodiments of the present disclosure.

Figure 1:
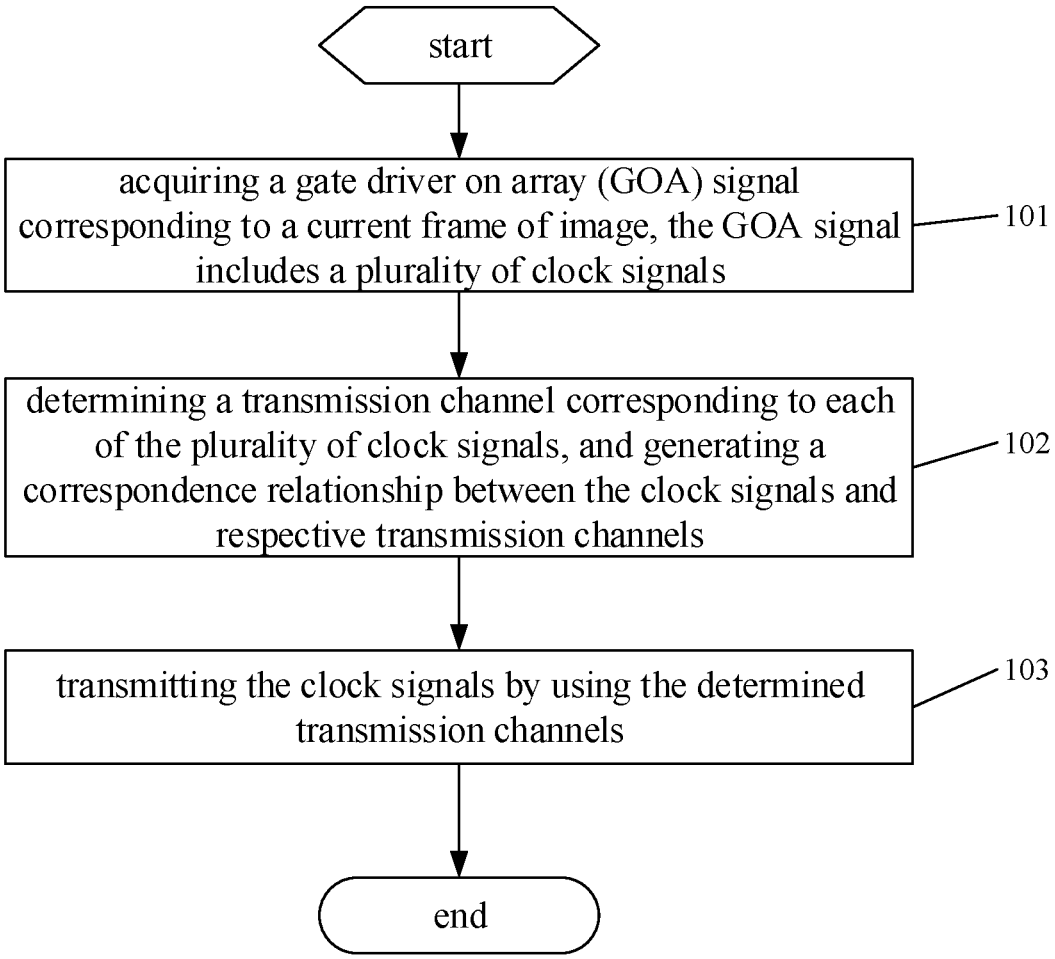
FIG. 1 is a flowchart of a method for driving a display panel according to the embodiments of the present disclosure.

As shown in FIG. 1, in one embodiment, the method for driving the display panel includes the following steps.

Step 101, acquiring a gate driver on array (GOA) signal corresponding to a current frame of image, the GOA signal includes a plurality of clock signals.

Figure 2:
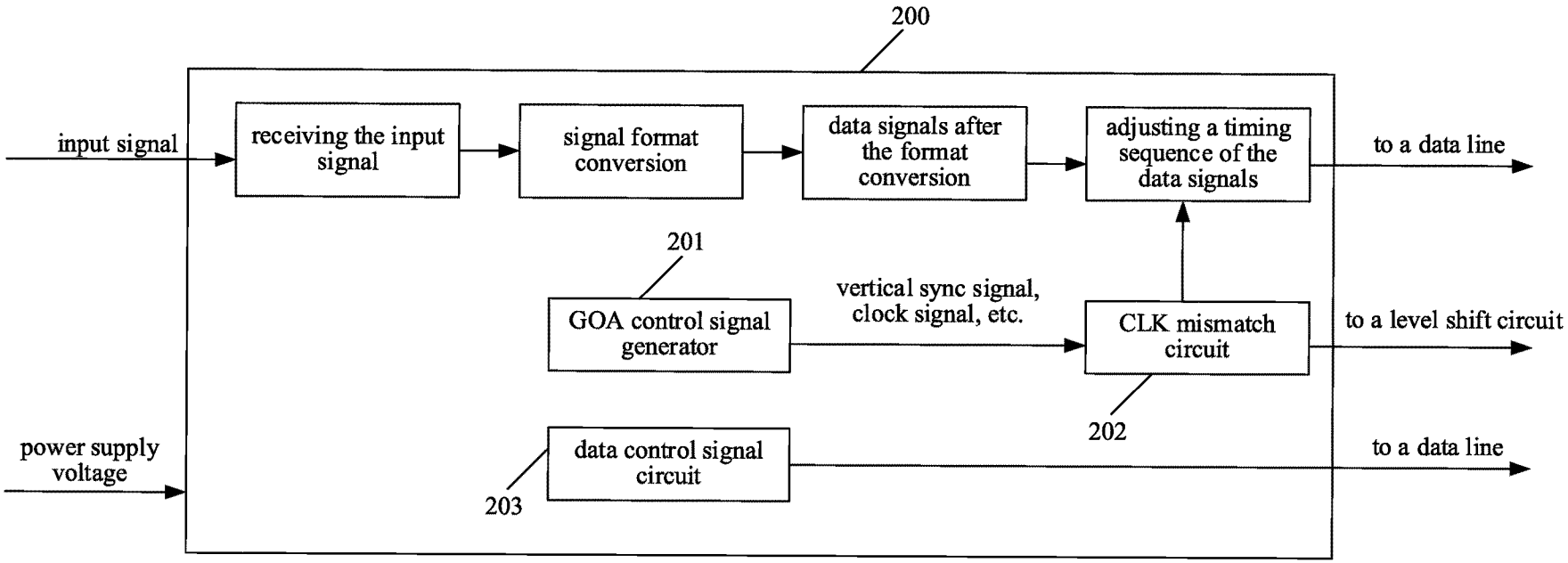
FIG. 2 is a schematic block diagram of a method for driving a display panel according to the embodiment of the present disclosure.

As shown in FIG. 2, in the embodiment, a GOA control signal generator 201 in a control chip (TCON) 200 generates the GOA signal at first. The generated GOA signal includes the plurality of clock signals. In addition, the GOA signal may further include some other signals, such as a start signal STV.

Figure 3:
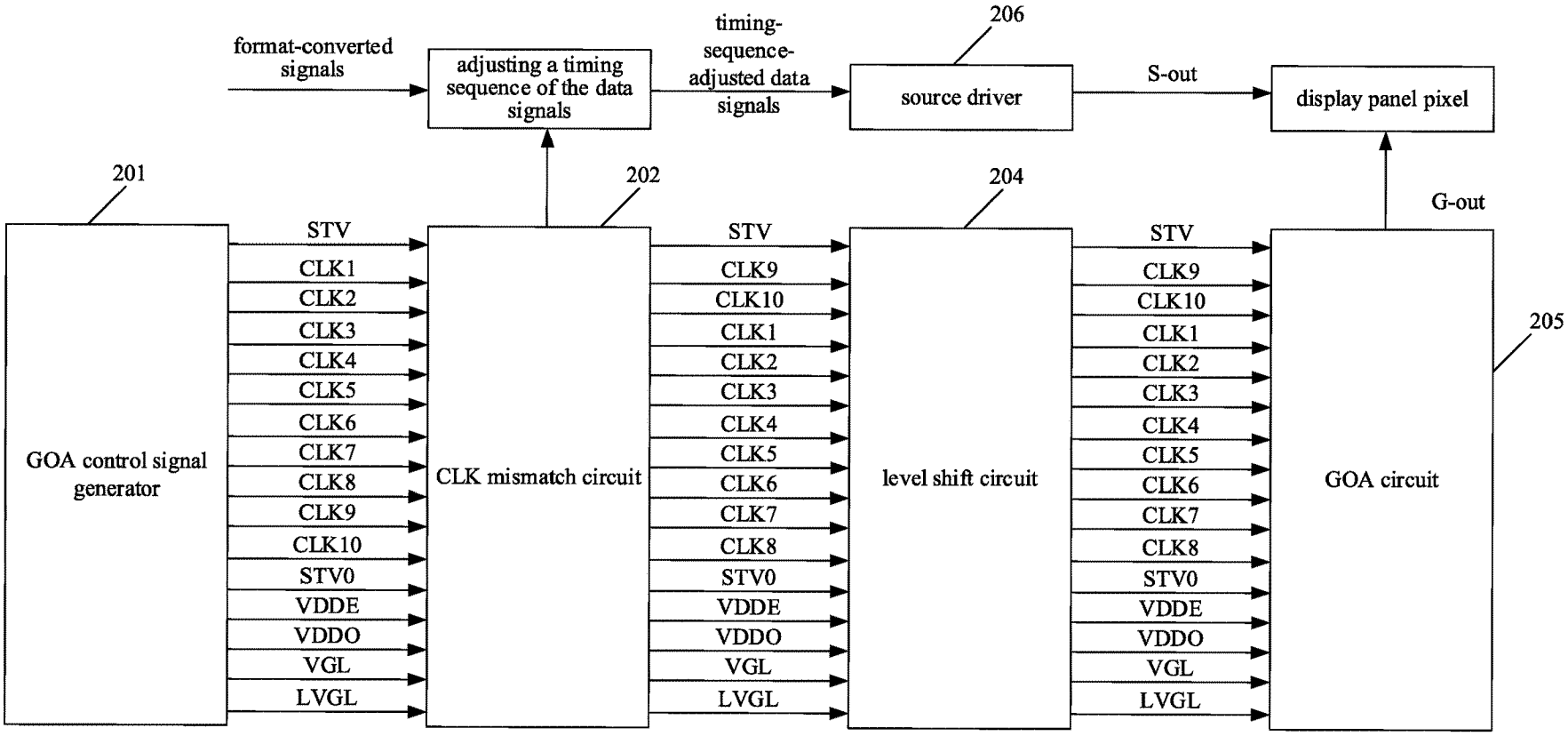
FIG. 3 is another schematic block diagram of a method for driving a display panel according to the embodiment of the present disclosure.
Figure 4:
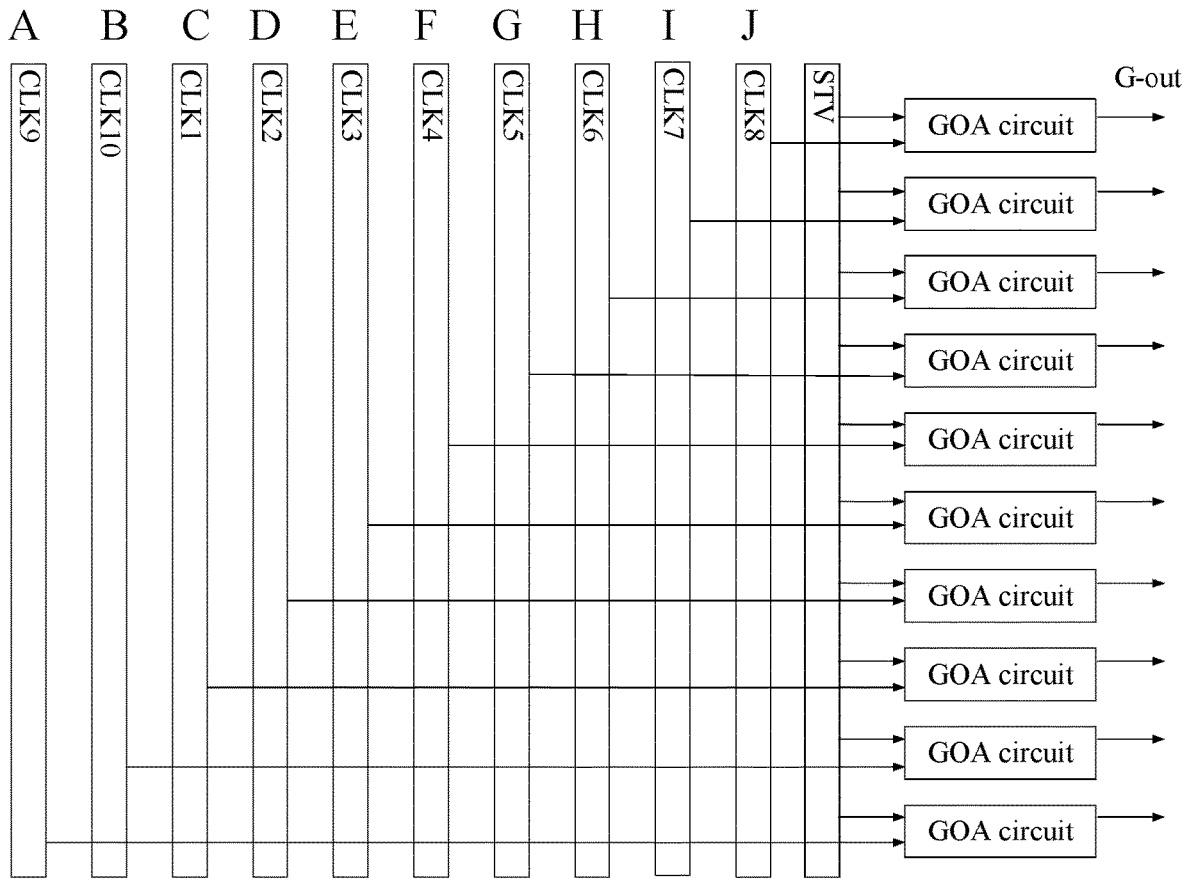
FIG. 4 is a schematic diagram of a correspondence relationship between clock signals and transmission channels in an embodiment of the present disclosure.
Figure 5:
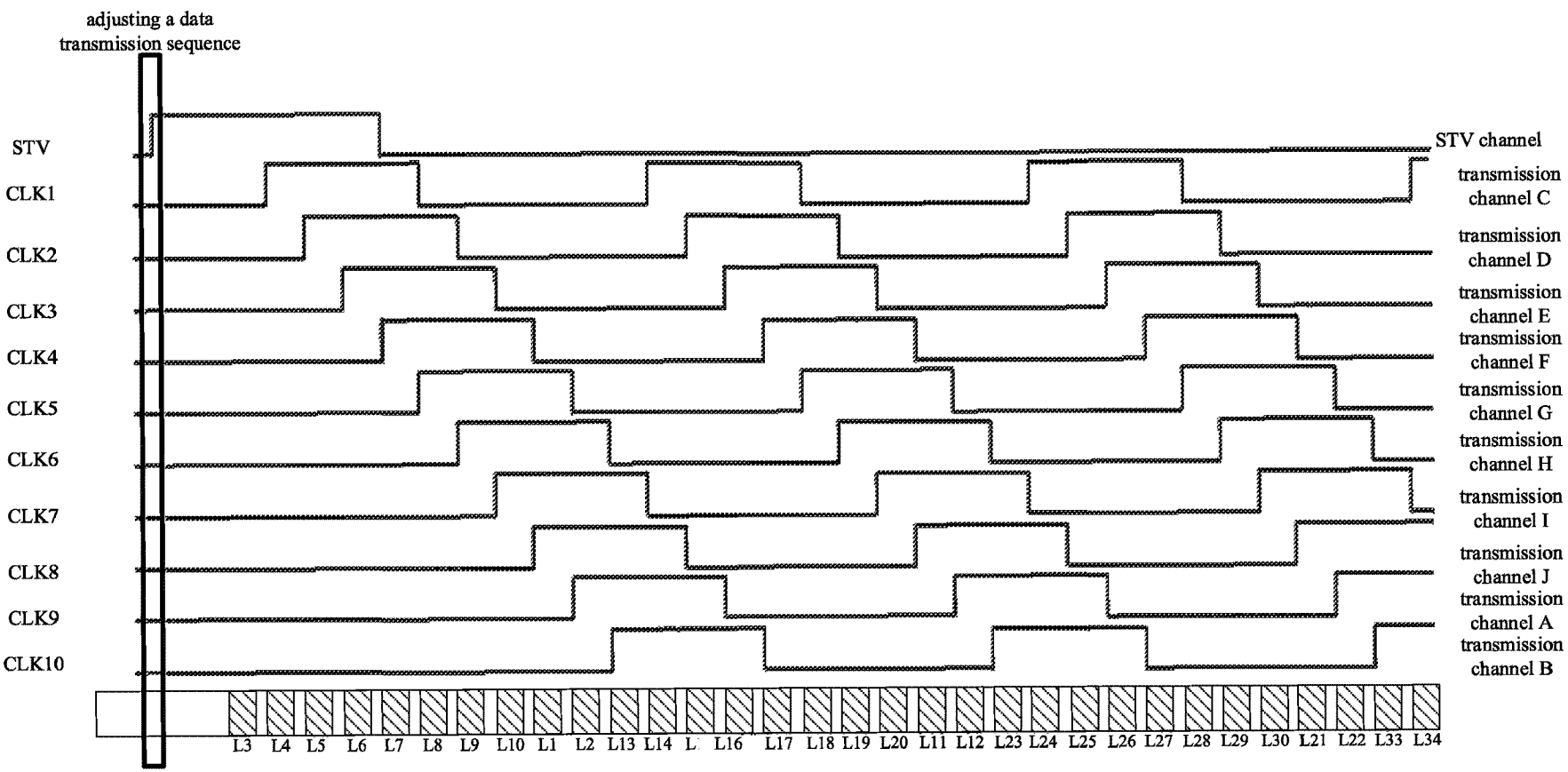
FIG. 5 is a timing sequence diagram of signals in an embodiment of the present disclosure.

As shown in FIG. 3 to FIG. 5, ten clock signals are taken as an example in the embodiment, where a first clock signal is denoted as CLK1, a second clock signal is denoted as CLK2, . . . , and a tenth clock signal is denoted as CLK10.

Step 102, determining a transmission channel corresponding to each of the plurality of clock signals, and generating a correspondence relationship between the clock signals and respective transmission channels.

In the embodiment, the clock signals are transmitted from the GOA control signal generator 201 to a GOA circuit 205 of the display panel via the transmission channels.

As shown in FIG. 3 to FIG. 5, the embodiment is described by taking a case in which the transmission channels used for transmitting the clock signals include a total of ten transmission channels corresponding to the clock signals, namely, a first transmission ermchannel (a transmission channel A), a second transmission channel (a transmission channel B), a third transmission channel (a transmission channel C), . . . , and a tenth transmission channel (a transmission channel J), as an example.

The transmission channels are only denoted by arrows in FIG. 3, the transmission channels are only denoted by alphabetic letters in FIG. 4, and the correspondence relationship between the transmission channels and the clock signals is illustrated.

Each transmission channel is used to transmit one clock signal. For example, in a specific embodiment, the CLK1 signal is transmitted through the transmission channel A, the CLK2 signal is transmitted through the transmission channel B, and so on, thereby realizing the transmission of the clock signals of the GOA signal.

In the technical solution of the embodiment, the current frame of image is different from at least one frame of image previous to the current frame of image with respect to the correspondence relationship between the clock signals and respective transmission channels.

That is to say, in case that the correspondence relationship between the clock signals and the transmission channels of the current frame of image is that the CLK1 signal is transmitted through the transmission channel A, the CLK2 signal is transmitted through the transmission channel B, and so on, the transmission channels of at least one frame of image are different therefrom, for example, it may be that the CLK1 signal is transmitted through the transmission channel B, the CLK2 signal is transmitted through the transmission channel C, and so on.

In other words, the correspondence relationship between the clock signals and the transmission channels is variable, rather than fixed, for image frames. Specifically, for example, there may be two frames of images of which the correspondence relationships between the clock signals and the transmission channels are the same, however, there is a high probability that the correspondence relationships between the clock signals and the transmission channels of two arbitrarily selected frames of images are different from each other.

Step 103, transmitting the clock signals by using the determined transmission channels.

After the correspondence relationship between the transmission channels and the clock signals is determined, the clock signals are transmitted according to the determined correspondence relationship.

In this way, the transmission channels for the clock signals of a plurality frames of images are controlled to be different in the embodiments of the present disclosure. That is to say, a clock signal corresponding to a same line may be transmitted through different transmission channels in different frames of images. From the perspective of the entire time dimension, the clock signal corresponding to each line may be transmitted through various transmission channels, thus the wiring resistance for the clock signal corresponding to each line is substantially uniform. Thereby, the charging effect of each line remains substantially the same, and the possibility of generating the periodic stripes is reduced, which is beneficial to improving the display effect.

Optionally, in a specific embodiment, the above step 102 includes: generating a random number corresponding to each frame of image, and determining the transmission channel corresponding to each of the plurality of clock signals based on the generated random number, and generating the correspondence relationship between the clock signals and respective transmission channels.

As shown in FIG. 2, the embodiment is described by taking a case in which an input signal is of a v-by-one format as an example. After receiving the input signal, the control chip 200 of the display panel converts the format to a signal format supported by the display panel. In the embodiment, a conversion to a CEDS signal (a kind of signal format) is taken as an example.

It should be appreciated that the format of the input signal and the format after conversion may be adapted according to practical situations and different signal formats may be selected, which is not further limited herein.

Further, as shown in FIG. 2 and FIG. 3, a CLK mismatch circuit 202 is provided to adjust a transmission sequence of the clock signals in the embodiment. The CLK mismatch circuit 202 receives a GOA signal from the GOA control signal generator 201. For a format of the GOA signal, a reference may be made to the related art, and the GOA signal specifically includes the start signal (STV) and the plurality of clock signals CLK, etc. In addition, the GOA signal may further include a termination signal (STV0), a first power supply signal VDDE, a second power supply signal VDD0, a first driving voltage VGL, a second driving voltage LVGL, etc.

As shown in FIG. 5, when a rising edge of the STV signal is received, it means that a GOA signal of a new frame of image is received, and a data transmission sequence may be adjusted. For example, in the embodiment, the random number corresponding to the frame of image is generated, and the correspondence relationship between the clock signals and the transmission channels is adjusted and determined according to the random number.

Since the random number is generated randomly, the corresponding correspondence relationship between the clock signals and the transmission channels is also random. Therefore, it may be achieved that the probabilities of each clock signal getting transmitted through all transmission channels are identical in the entire timescale. In other words, it may be assumed that the wiring resistance experienced when each clock signal is transmitted is substantially the same. In this way, the impact of the wiring resistance on each clock signal is substantially the same, thereby reducing a possible impact on the display effect.

In an optional specific embodiment, the generating the random number specifically includes generating a randomly arranged sequence of numbers, and then the correspondence relationship between the clock signals and the transmission channels is determined according to the generated random number sequence.

Specifically, both a quantity of the transmission channels and a quantity of the clock signals are M, and M is a positive integer. The determining the transmission channel corresponding to each of the plurality of clock signals based on the generated random number, and generating the correspondence relationship between the clock signals and respective transmission channels includes: generating a randomly arranged sequence including M random numbers that corresponds to the current frame of image; taking the randomly arranged sequence as a first arrangement sequence corresponding to M clock signals; where the M transmission channels are arranged sequentially; and determining the transmission channel corresponding to each of the M clock signals based on the first arrangement sequence and the M transmission channels arranged sequentially, and generating the correspondence relationship between the clock signals and respective transmission channels.

By way of example, there are a total of ten clock signals, namely, CLK1, CLK2, . . . , and CLK10, and a total of ten transmission channels, namely, A, B, C, and J.

During implementation, a process of generating the random number specifically includes generating a randomly arranged sequence of 1 to 10, for example, it may be 5, 9, 3, 2, 4, 8, 7, 6, 1, 10. Then the clock signal CLK5 corresponds to the transmission channel A, the clock signal CLK9 corresponds to the transmission channel B, the clock signal CLK3 corresponds to the transmission channel C, and so on. In this way, a correspondence relationship between the clock signals and the transmission channels is obtained.

For another frame of image, a randomly arranged sequence of 1 to 10 is re-generated, and a correspondence relationship between the clock signals and the transmission channels is determined accordingly. In this way, since the randomly arranged sequences corresponding to the frames of images are different from each other, the corresponding correspondence relationships between the clock signals and the transmission channels are also different from each other.

In another optional specific embodiment, only one random number is generated, which is beneficial to reducing a calculation amount.

Specifically, both a quantity of the transmission channels and a quantity of the clock signals are M, and M is a positive integer. The determining the transmission channel corresponding to each of the plurality of clock signals based on the generated random number, and generating the correspondence relationship between the clock signals and respective transmission channels includes: generating a random number N corresponding to the current frame of image, where N is a positive integer and N is not greater than M; determining that a Kth clock signal corresponds to a (K+N−1)th transmission channel in a case that K+N−1 is not greater than M; K is a positive integer and is less than or equal to M; and determining that a Kth clock signal corresponds to a (K+N−1−M)th transmission channel in a case that K+N−1 is greater than M.

Similarly, by way of example, there are a total of ten clock signals, which are denoted as CLK1, CLK2, . . . , and CLK10 respectively, and a total of ten transmission channels, which are denoted as A, B, C, . . . , and J respectively. That is, M=10.

A process of generating the random number N specifically includes generating an integer greater than or equal to 1 and less than or equal to 10. A generated random number N=3 is taken as an example.

As shown in FIG. 3 and FIG. 4, when K=1, K+N−1=3, thus the first clock signal corresponds to the (K+N−1)th transmission channel, i.e., the third transmission channel. That is, the clock signal CLK1 corresponds to the transmission channel C. For another example, when K=5, K+N−1=7, thus the fifth clock signal corresponds to the seventh transmission channel. That is, the clock signal CLK5 corresponds to the transmission channel G. For another example, when K=10, K+N−1=12. According to the above correspondence relationship, since 12 is greater than 10, the tenth clock signal corresponds to the (K+N−1−M)th transmission channel, i.e., the tenth clock signal corresponds to the second transmission channel. That is, the clock signal CLK10 corresponds to the transmission channel B. In this way, a correspondence relationship between the clock signals and the transmission channels may be established.

Referring to the following Table 1, a scheme of assigning transmission channels to the clock signals when different random numbers N are obtained according to a specific embodiment is illustrated.

TABLE 1 a scheme of assigning transmission channels to the clock signals

| | A | B | C | D | E | F | G | H | I | J |
|---|---|---|---|---|---|---|---|---|---|---|
| N = 1 | CLK1 | CLK2 | CLK3 | CLK4 | CLK5 | CLK6 | CLK7 | CLK8 | CLK9 | CLK10 |
| N = 2 | CLK10 | CLK1 | CLK2 | CLK3 | CLK4 | CLK5 | CLK6 | CLK7 | CLK8 | CLK9 |
| N = 3 | CLK9 | CLK10 | CLK 1 | CLK2 | CLK3 | CLK4 | CLK5 | CLK6 | CLK7 | CLK8 |
| N = 4 | CLK8 | CLK9 | CLK10 | CLK1 | CLK2 | CLK3 | CLK4 | CLK5 | CLK6 | CLK7 |
| N = 5 | CLK7 | CLK8 | CLK9 | CLK10 | CLK1 | CLK2 | CLK3 | CLK4 | CLK5 | CLK6 |
| N = 6 | CLK6 | CLK7 | CLK8 | CLK9 | CLK10 | CLK1 | CLK2 | CLK3 | CLK4 | CLK5 |
| N = 7 | CLK5 | CLK6 | CLK7 | CLK8 | CLK9 | CLK10 | CLK1 | CLK2 | CLK3 | CLK4 |
| N = 8 | CLK4 | CLK5 | CLK6 | CLK7 | CLK8 | CLK9 | CLK10 | CLK1 | CLK2 | CLK3 |
| N = 9 | CLK3 | CLK4 | CLK5 | CLK6 | CLK7 | CLK8 | CLK9 | CLK10 | CLK1 | CLK2 |
| N = 10 | CLK2 | CLK3 | CLK4 | CLK5 | CLK6 | CLK7 | CLK8 | CLK9 | CLK10 | CLK1 |

As shown in Table 1, as long as the random number corresponding to each frame of image is generated, the correspondence relationship between the clock signals and the transmission channels may be determined accordingly. As long as the random numbers corresponding to two frames of images are different, the corresponding correspondence relationships between the clock signals and the transmission channels are also different.

Obviously, the correspondence relationship between the clock signals and the transmission channels may also be established in other ways.

Specifically, both a quantity of the transmission channels and a quantity of the clock signals are M, and M is a positive integer. The determining the transmission channel corresponding to each of the plurality of clock signals based on the generated random number, and generating the correspondence relationship between the clock signals and respective transmission channels includes: generating a random number N corresponding to the current frame of image, where N is a positive integer and N is not greater than M; determining that a Kth transmission channel corresponds to a (K+N−1)th clock signal in a case that K+N−1 is not greater than M; K is a positive integer and is less than or equal to M; and determining that a Kth transmission channel corresponds to a (K+N−1−M)th clock signal in a case that K+N−1 is greater than M.

Specifically, both a quantity of the transmission channels and a quantity of the clock signals are M, and M is a positive integer. The determining the transmission channel corresponding to each of the plurality of clock signals based on the generated random number, and generating the correspondence relationship between the clock signals and respective transmission channels includes: generating a randomly arranged sequence including M random numbers that corresponds to the current frame of image; taking the randomly arranged sequence as a second arrangement sequence corresponding to M transmission channels; where M clock signals are arranged sequentially; and determining the transmission channel corresponding to each of the M clock signals based on the second arrangement sequence and the M clock signals arranged sequentially, and generating the correspondence relationship between the clock signals and respective transmission channels.

For example, if the generated random number is 3, then the first transmission channel is used to transmit the third clock signal, and the second transmission channel is used to transmit the fourth clock signal, that is, the transmission channel A corresponds to the clock signal CLK3, the transmission channel B corresponds to the clock signal CLK4, . . . , the transmission channel J corresponds to the clock signal CLK2.

By generating the random number and determining the correspondence relationship between the transmission channels and the clock signals based on the generated random number, it may be ensured that the probabilities of a clock signal getting transmitted through all transmission channels are identical. Thus, a random matching of the clock signals and the transmission channels is achieved, such that the transmission wiring resistances experienced by the clock signals are more uniform in the entire timescale.

As shown in FIG. 3 and FIG. 4, after a configuration such as adjustment of the GOA signal is finished, the configured GOA signal is sent to a level shift circuit 204, and the level shift circuit 204 generates an input signal required by the GOA circuit 205 of the display panel. The input signal is inputted to the GOA circuit 205, and the GOA circuit 205 generates a corresponding line driving signal (G-out).

Optionally, subsequent to the transmitting the clock signals by using the determined transmission channels, the method for driving the display panel further includes: adjusting a transmission timing sequence of data signals so that the transmission timing sequence of the data signals matches a timing sequence of the clock signals, where the timing sequence of the clock signals is determined based on the correspondence relationship between the clock signals and the transmission channels.

After the transmission of the clock signals is finished, the timing sequence of the data signals requires to be further adjusted, so that a transmission sequence of the data signals matches the timing sequence of the clock signals, thereby ensuring that an image may be displayed properly.

Specifically, the CLK mismatch circuit 202 synchronizes the adjustment manner for the GOA signal with a circuit for adjusting the data signals, such as an Adjusting CEDS Tx circuit, to adjust the transmission timing sequence of the data signals.

For example, when the correspondence relationship between the clock signals and the transmission channels is determined by means of generating the random number, the CLK mismatch circuit 202 also sends the generated random number to the Adjusting CEDS Tx circuit, so that the Adjusting CEDS Tx circuit may adjust the sequence, or the timing sequence, of the data signals accordingly.

In an optional specific embodiment, the adjusting the transmission timing sequence of the data signals so that the transmission timing sequence of the data signals matches the timing sequence of the clock signals specifically includes: dividing the data signals sequentially into a plurality of groups according to the quantity of the clock signals, where a quantity of data signals in each of the plurality of groups is equal to the quantity of the clock signals; and adjusting a timing sequence of the data signals in each of the plurality of groups so that the timing sequence of the data signals in each of the plurality of groups matches the timing sequence of the clock signals.

The GOA signal including 10 clock signals is taken as an example. The quantity of data lines is usually large. In this embodiment, 2160 lines of data signals are taken as an example. According to the quantity of the clock signals, every 10 lines of data signals are grouped together. That is, a first line to a tenth line form a first group, an eleventh line to a twentieth line form a second group, . . . , a 2151st line to a 2160th line form a 216th group, and so on.

After the data lines is grouped, the timing sequence of the data signals of each group is adjusted to be consistent with the transmission sequence of the clock signals.

Specifically, when the correspondence relationship between the clock signals and the transmission channels is determined in a manner of generating ten random numbers in the aforementioned specific embodiment, the transmission sequence of the data signals is adjusted to be a 5th line, a 9th line, a 3rd line, a 2nd line, a 4th line, an 8th line, a 7th line, a 6th line, a 1st line, a 10th line, a 15th line, a 19th line, a 13th line, a 12th line, a 14th line, an 18th line, a 17th line, a 16th line, an 11th line, a 20th line, . . . , a 2155th line, a 2159th line, a 2153rd line, a 2152nd line, a 2154th line, a 2158th line, a 2157th line, a 2156th line, a 2151st line, a 2160th line, and so on.

For another example, the correspondence relationship between the clock signals and the transmission channels includes: the clock signal CLK1 corresponds to the transmission channel C, the clock signal CLK2 corresponds to the transmission channel D, the clock signal CLK3 corresponds to the transmission channel E, . . . , and the clock signal CLK10 corresponds to the transmission channel B, as described in the foregoing embodiment. Then, the transmission sequence of the data signals is adjusted to be a 3rd line, a 4th line, a 5th line, a 6th line, a 7th line, an 8th line, a 9th line, a 10th line, a 1st line, a 2nd line, a 13th line, a 14th line, a 15th line, a 16th line, a 17th line, an 18th line, a 19th line, a 20th line, an 11th line, a 12th line, . . . , a 2153rd line, a 2154th line, a 2155th line, a 2156th line, a 2157th line, a 2158th line, a 2159th line, a 2160th line, a 2151st line, a 2152nd line, . . . , and so on.

Referring to Table 2, a configuration scheme of the transmission timing sequence of the data signals when N takes different values in an embodiment corresponding to Table 1 is illustrated.

TABLE 2

| | a configuration scheme of the transmission timing sequence of the data signals |
|---|---|
| N = 1 | L1→L2→L3→L4→L5→L6→L7→L8→L9→L10→L11→L12→L13→L14→L15→L6→L17→L18→L19→L20→L21 . . . |
| N = 2 | L2→L3→L4→L5→L6→L7→L8→L9→L10→L1→L12→L13→L14→L15→L6→L17→L18→L19→L20→L11→L22 . . . |
| N = 3 | L3→L4→L5→L6→L7→L8→L9→L10→L1→L2→L13→L14→L15→L6→L17→L18→L19→L20→L11→L12→L23 . . . |
| N = 4 | L4→L5→L6→L7→L8→L9→L10→L1→L2→L3→L14→L15→L6→L17→L18→L19→L20→L11→L12→L13→L24 . . . |
| N = 5 | L5→L6→L7→L8→L9→L10→L1→L2→L3→L4→L15→L6→L17→L18→L19→L20→L11→L12→L13→L14→L25 . . . |
| N = 6 | L6→L7→L8→L9→L10→L1→L2→L3→L4→L5→L6→L17→L18→L19→L20→L11→L12→L13→L14→L15→L26 . . . |
| N = 7 | L7→L8→L9→L10→L1→L2→L3→L4→L5→L6→L17→L18→L19→L20→L11→L12→L13→L14→L15→L6→L27 . . . |
| N = 8 | L8→L9→L10→L1→L2→L3→L4→L5→L6→L7→L18→L19→L20→L11→L12→L13→L14→L15→L6→L17→L28 . . . |
| N = 9 | L9→L10→L1→L2→L3→L4→L5→L6→L7→L8→L19→L20→L11→L12→L13→L14→L15→L6→L17→L18→L29 . . . |

TABLE 2-continued

| | a configuration scheme of the transmission timing sequence of the data signals |
|---|---|
| N = 10 | L10→L1→L2→L3→L4→L5→L6→L7→L8→L19→L20→ L11→L12→L13→L14→L15→L6→L17→L18→L19→L30 . . . |

As shown in Table 2, when the generated random number varies, the transmission timing sequence of data signals requires to be adjusted accordingly.

In some embodiments, an option of N=0 may be added. In an practical operation, if the CLK mismatch function is not required, for example in a low resolution or low frame frequency product of the related art where a pixel charging rate may reach 100%, adjustment may be made so that N=0, then the CLK mismatch function is turned off, thereby saving power.

As shown in FIG. 2 and FIG. 3, having been adjusted in respect to the timing sequence, the data signals enter a source driver 206, and data output signals (S-out) are generated. The data output signals are further transmitted to respective pixels on the display panel and charge the pixels with required gray-scale voltages, thereby achieving the display of one frame of image.

In addition, as shown in FIG. 2, the control chip 200 is also configured to generate corresponding data control signals and the like by using a data control signal circuit 203. For a detailed description thereof, reference may be made to the related art. Details thereof will not be repeated herein.

Thus, by continuously repeating the above process for each frame of image, a normal display of the image may be realized.

Moreover, each clock signal occupies a definite transmission channel in a same frame of image, while the correspondence relationships between the clock signals and the transmission channels are randomly determined when different frames of images are displayed. So overall, the difference caused by the electric resistances (or wiring resistances) of different transmission channels may be eliminated, thereby mitigating an impact on the display effect due to different resistances of transmission channels.

Figure 6:
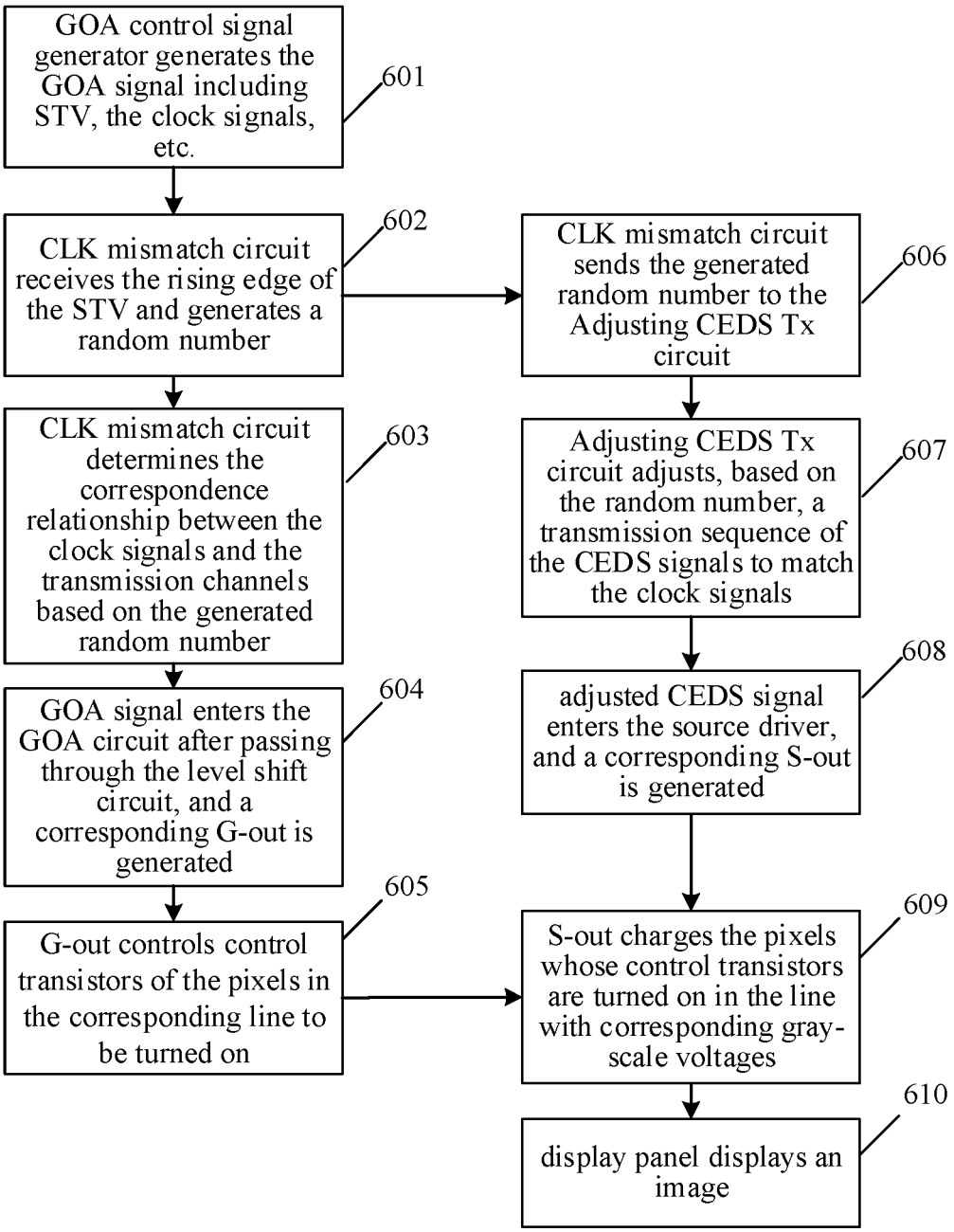
FIG. 6 is a flowchart of a method for driving a display panel according to the embodiments of the present disclosure.
Figure 7:
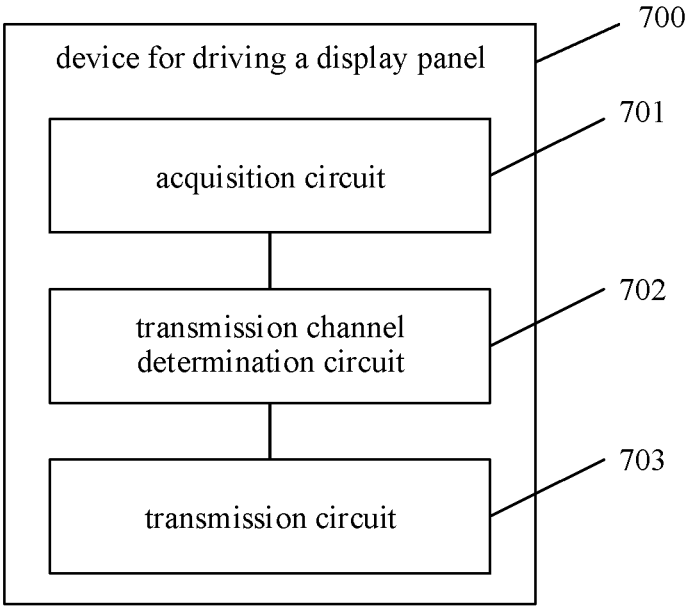
FIG. 7 is a schematic structural diagram of a device for driving a display panel according to an embodiment of the present disclosure.

As shown in FIG. 6, the technical solution of the embodiment may be summarized as including following steps.

Step 601: the GOA control signal generator 201 generates the GOA signal. The GOA signal includes at least the start signal and the clock signals, and the start signal is used to identify a new frame of image.

Step 602: the CLK mismatch circuit receives the rising edge of the start signal and generates the random number.

Step 603: the CLK mismatch circuit determines the correspondence relationship between the clock signals and the transmission channels based on the generated random number.

After receiving the rising edge of the start signal, the CLK mismatch circuit 202 determines the correspondence relationship between the clock signals and the transmission channels. For example, the correspondence relationship may be determined by generating the random number, so that the correspondence relationships of different frames of images are different.

Step 606: the CLK mismatch circuit sends the generated random number to the Adjusting CEDS Tx circuit.

Step 607: the Adjusting CEDS Tx circuit adjusts, based on the random number, a transmission sequence of the CEDS signals to match the clock signals.

The CLK mismatch circuit 202 also sends the generated correspondence relationship to a circuit for processing the data signals, such as the Adjusting CEDS Tx circuit. The Adjusting CEDS Tx circuit adjusts the data signals according to the correspondence relationship, so that the data signals match the clock signals.

Step 604: the GOA signal enters the GOA circuit after passing through the level shift circuit, and a corresponding line driving signal is generated.

Step 605: the line driving signal controls control transistors of the pixels in the corresponding line to be turned on.

Step 608: the adjusted CEDS signal enters the source driver, and a corresponding data output signal is generated.

Step 609: the data output signal charges the pixels whose control transistors are turned on in the line with corresponding gray-scale voltages.

Step 610: the display panel displays an image.

For subsequent processes, reference may be made to the related art. Specifically, the GOA signal having undergone the sequence adjustment is further subjected to other processing to generate a driving signal. For example, having been level-shifted by the level shift circuit 204, the GOA signal is sent to the GOA circuit 205 to generate the required line driving signal. Having been adjusted in respect to the timing sequence, the data signals are inputted to the source driver 206 to generate the data output signal. The driving signal is used to control the control transistor, such as a thin film transistor (TFT), of the pixel to be turned on. The data output signal charges the pixels whose control transistors are turned on in the line with the corresponding gray-scale voltages, and the display panel may display an image normally.

Further, a device 700 for driving a display panel is provided in the embodiments of the present disclosure. The device includes: an acquisition circuit 701, configured to acquire a GOA signal corresponding to a current frame of image, where the GOA signal includes a plurality of clock signals; a transmission channel determination circuit 702, configured to determine a transmission channel corresponding to each of the plurality of clock signals, and generate a correspondence relationship between the clock signals and respective transmission channels, where the transmission channels are used to deliver the clock signals from a GOA control signal generator 201 to a GOA circuit 205 of the display panel, the current frame of image is different from at least one frame of image previous to the current frame of image with respect to the correspondence relationship between the clock signals and respective transmission channels; and a transmission circuit 703, configured to transmit the clock signals by using the determined transmission channels.

Optionally, the transmission channel determination circuit 702 is specifically configured to: generate a random number corresponding to each frame of image, and determine the transmission channel corresponding to each of the plurality of clock signals based on the generated random number, and generate the correspondence relationship between the clock signals and respective transmission channels.

Optionally, both a quantity of the transmission channels and a quantity of the clock signals are M, M is a positive integer, and the transmission channel determination circuit 702 includes: a random number generation sub-circuit, configured to generate a random number N corresponding to the current frame of image, where N is a positive integer and N is not greater than M; and a transmission channel determination sub-circuit, configured to determine that a Kth clock signal corresponds to a (K+N−1)th transmission channel in a case that K+N−1 is not greater than M; K is a positive integer and is less than or equal to M; and configured to determine that a Kth clock signal corresponds to a (K+N−1−M)th transmission channel in a case that K+N−1 is greater than M.

Optionally, both a quantity of the transmission channels and a quantity of the clock signals are M, M is a positive integer, and the transmission channel determination circuit 702 includes: a random number generation sub-circuit, configured to generate a random number N corresponding to the current frame of image, where N is a positive integer and N is not greater than M; and a transmission channel determination sub-circuit, configured to determine that a Kth transmission channel corresponds to a (K+N−1)th clock signal in a case that K+N−1 is not greater than M; K is a positive integer and is less than or equal to M; and configured to determine that a Kth transmission channel corresponds to a (K+N−1−M)th clock signal in a case that K+N−1 is greater than M.

Optionally, both a quantity of the transmission channels and a quantity of the clock signals are M, M is a positive integer, and the transmission channel determination circuit 702 includes: a random number generation sub-circuit, configured to generate a randomly arranged sequence comprising M random numbers that corresponds to the current frame of image; and a transmission channel determination sub-circuit, configured to take the randomly arranged sequence as a first arrangement sequence corresponding to M clock signals; where M transmission channels are arranged sequentially; and configured to determine the transmission channel corresponding to each of the M clock signals based on the first arrangement sequence and the M transmission channels arranged sequentially, and generate the correspondence relationship between the clock signals and respective transmission channels.

Optionally, both a quantity of the transmission channels and a quantity of the clock signals are M, M is a positive integer, and the transmission channel determination circuit 702 includes: a random number generation sub-circuit, configured to generate a randomly arranged sequence comprising M random numbers that corresponds to the current frame of image; and a transmission channel determination sub-circuit, configured to take the randomly arranged sequence as a second arrangement sequence corresponding to M transmission channels; where M clock signals are arranged sequentially; and configured to determine the transmission channel corresponding to each of the M clock signals based on the second arrangement sequence and the M clock signals arranged sequentially, and generate the correspondence relationship between the clock signals and respective transmission channels.

Optionally, the device 700 for driving the display panel further includes: a timing sequence adjustment circuit, configured to adjust a transmission timing sequence of data signals so that the transmission timing sequence of the data signals matches a timing sequence of the clock signals, where the timing sequence of the clock signals is determined based on the correspondence relationship between the clock signals and the transmission channels.

Optionally, the timing sequence adjustment circuit includes: a group division sub-circuit, configured to divide the data signals sequentially into a plurality of groups according to the quantity of the clock signals, where a quantity of data signals in each of the plurality of groups is equal to the quantity of the clock signals; and an adjustment sub-circuit, configured to adjust a timing sequence of the data signals in each of the plurality of groups so that the timing sequence of the data signals in each of the plurality of groups matches the timing sequence of the clock signals.

A device for driving a display panel is further provided in the embodiments of the present disclosure. The device includes: a memory and an executor, the executor is configured to execute the following instructions stored in the memory: acquiring a GOA signal corresponding to a current frame of image, where the GOA signal includes a plurality of clock signals; determining a transmission channel corresponding to each of the plurality of clock signals, and generating a correspondence relationship between the clock signals and respective transmission channels, where the transmission channels are used to deliver the clock signals from a GOA control signal generator to a GOA circuit of the display panel, the current frame of image is different from at least one frame of image previous to the current frame of image with respect to the correspondence relationship between the clock signals and respective transmission channels; and transmitting the clock signals by using the determined transmission channels.

Optionally, the executor is further configured to execute the following instructions stored in the memory: generating a random number corresponding to each frame of image, and determining the transmission channel corresponding to each of the plurality of clock signals based on the generated random number, and generating the correspondence relationship between the clock signals and respective transmission channels.

Optionally, both a quantity of the transmission channels and a quantity of the clock signals are M, M is a positive integer, the executor is further configured to execute the following instructions stored in the memory: generating a random number N corresponding to the current frame of image, where N is a positive integer and N is not greater than M; determining that a Kth clock signal corresponds to a (K+N−1)th transmission channel in a case that K+N−1 is not greater than M; K is a positive integer and is less than or equal to M; and determining that a Kth clock signal corresponds to a (K+N−1−M)th transmission channel in a case that K+N−1 is greater than M.

Optionally, both a quantity of the transmission channels and a quantity of the clock signals are M, M is a positive integer, the executor is further configured to execute the following instructions stored in the memory: generating a random number N corresponding to the current frame of image, where N is a positive integer and N is not greater than M; determining that a Kth transmission channel corresponds to a (K+N−1)th clock signal in a case that K+N−1 is not greater than M; K is a positive integer and is less than or equal to M; and determining that a Kth transmission channel corresponds to a (K+N−1−M)th clock signal in a case that K+N−1 is greater than M.

Optionally, both a quantity of the transmission channels and a quantity of the clock signals are M, M is a positive integer, the executor is further configured to execute the following instructions stored in the memory: generating a randomly arranged sequence including M random numbers that corresponds to the current frame of image; taking the randomly arranged sequence as a first arrangement sequence corresponding to M clock signals; where M transmission channels are arranged sequentially; and determining the transmission channel corresponding to each of the M clock signals based on the first arrangement sequence and the M transmission channels arranged sequentially, and generating the correspondence relationship between the clock signals and respective transmission channels.

Optionally, both a quantity of the transmission channels and a quantity of the clock signals are M, M is a positive integer, the executor is further configured to execute the following instructions stored in the memory: generating a randomly arranged sequence including M random numbers that corresponds to the current frame of image; taking the randomly arranged sequence as a second arrangement sequence corresponding to M transmission channels; where M clock signals are arranged sequentially; and determining the transmission channel corresponding to each of the M clock signals based on the second arrangement sequence and the M clock signals arranged sequentially, and generating the correspondence relationship between the clock signals and respective transmission channels.

Optionally, the executor is further configured to execute the following instructions stored in the memory: adjusting a transmission timing sequence of data signals so that the transmission timing sequence of the data signals matches a timing sequence of the clock signals, where the timing sequence of the clock signals is determined based on the correspondence relationship between the clock signals and the transmission channels.

Optionally, the executor is further configured to execute the following instructions stored in the memory: dividing the data signals sequentially into a plurality of groups according to the quantity of the clock signals, where a quantity of data signals in each of the plurality of groups is equal to the quantity of the clock signals; and adjusting a timing sequence of the data signals in each of the plurality of groups so that the timing sequence of the data signals in each of the plurality of groups matches the timing sequence of the clock signals.

The device 700 for driving the display panel in the embodiment of the present disclosure may implement various processes in the above embodiment of the method for driving the display panel, which are not repeated herein to avoid repetition.

A display device is further provided in the embodiments of the present disclosure. The display device includes a display panel and any one of the devices 700 for driving the display panel described above. Since the display device includes any one of the devices 700 for driving the display panel described above, at least all the above technical effects may be realized, which are not repeated herein to avoid repetition.

The above are merely specific embodiments of the present disclosure, but a scope of the present disclosure is not limited thereto. Any modifications or replacements that would easily occurred to those skilled in the art, without departing from the technical scope disclosed in the disclosure, should be encompassed in the scope of the present disclosure. Therefore, the scope of the present disclosure shall be defined by the scope of the claims.

What is claimed is:

1. A method for driving a display panel, comprising:

acquiring a gate driver on array (GOA) signal corresponding to a current frame of image, wherein the GOA signal comprises a plurality of clock signals;

determining a transmission channel corresponding to each of the plurality of clock signals, and generating a correspondence relationship between the clock signals and respective transmission channels, wherein the transmission channels are used to deliver the clock signals from a GOA control signal generator to a GOA circuit of the display panel, the current frame of image is different from at least one frame of image previous to the current frame of image with respect to the correspondence relationship between the clock signals and respective transmission channels; and transmitting the clock signals by using the determined transmission channels, wherein the determining the transmission channel corresponding to each of the plurality of clock signals, and generating the correspondence relationship between the clock signals and respective transmission channels comprises generating a random number corresponding to each frame of image, and determining a transmission channel corresponding to each of the plurality of clock signals based on the generated random number, and generating the correspondence relationship between the clock signals and respective transmission channels.

2. The method for driving the display panel according to claim 1, wherein both a quantity of the transmission channels and a quantity of the clock signals are M, M is a positive integer, and the determining the transmission channel corresponding to each of the plurality of clock signals based on the generated random number, and generating the correspondence relationship between the clock signals and respective transmission channels comprises:

generating a random number N corresponding to the current frame of image, wherein N is a positive integer and is not greater than M;

determining that a Kth clock signal corresponds to a (K+N−1)th transmission channel in a case that K+N−1 is not greater than M, wherein K is a positive integer and is less than or equal to M; and determining that the Kth clock signal corresponds to a (K+N−1−M)th transmission channel in a case that K+N−1 is greater than M.

3. The method for driving the display panel according to claim 1, wherein both a quantity of the transmission channels and a quantity of the clock signals are M, M is a positive integer, and the determining the transmission channel corresponding to each of the plurality of clock signals based on the generated random number, and generating the correspondence relationship between the clock signals and respective transmission channels comprises:

generating a random number N corresponding to the current frame of image, wherein N is a positive integer and is not greater than M;

determining that a Kth transmission channel corresponds to a (K+N−1)th clock signal in a case that K+N−1 is not greater than M, wherein K is a positive integer and is less than or equal to M; and determining that a Kth transmission channel corresponds to a (K+N−1−M)th clock signal in a case that K+N−1 is greater than M.

4. The method for driving the display panel according to claim 1, wherein both a quantity of the transmission channels and a quantity of the clock signals are M, M is a positive integer, and the determining the transmission channel corresponding to each of the plurality of clock signals based on the generated random number, and generating the correspondence relationship between the clock signals and respective transmission channels comprises:

generating a randomly arranged sequence comprising M random numbers that corresponds to the current frame of image;

taking the randomly arranged sequence as a first arrangement sequence corresponding to M clock signals; wherein M transmission channels are arranged sequentially; and determining the transmission channel corresponding to each of the M clock signals based on the first arrangement sequence and the M transmission channels arranged sequentially, and generating the correspondence relationship between the clock signals and respective transmission channels.

5. The method for driving the display panel according to claim 1, wherein both a quantity of the transmission channels and a quantity of the clock signals are M, M is a positive integer, and the determining the transmission channel corresponding to each of the plurality of clock signals based on the generated random number, and generating the correspondence relationship between the clock signals and respective transmission channels comprises:

generating a randomly arranged sequence comprising M random numbers that corresponds to the current frame of image;

taking the randomly arranged sequence as a second arrangement sequence corresponding to M transmission channels; wherein M clock signals are arranged sequentially; and determining the transmission channel corresponding to each of the M clock signals based on the second arrangement sequence and the M clock signals arranged sequentially, and generating the correspondence relationship between the clock signals and respective transmission channels.

6. The method for driving the display panel according to claim 1, wherein, subsequent to the transmitting the clock signals by using the determined transmission channels, the method further comprises:

adjusting a transmission timing sequence of data signals so that the transmission timing sequence of the data signals matches a timing sequence of the clock signals, wherein the timing sequence of the clock signals is determined based on the correspondence relationship between the clock signals and respective transmission channels.

7. The method for driving the display panel according to claim 6, wherein the adjusting the transmission timing sequence of the data signals so that the transmission timing sequence of the data signals matches the timing sequence of the clock signals comprises:

dividing the data signals sequentially into a plurality of groups according to a quantity of the clock signals, wherein a quantity of data signals in each of the plurality of groups is equal to the quantity of the clock signals; and adjusting a timing sequence of the data signals in each of the plurality of groups so that the timing sequence of the data signals in each of the plurality of groups matches the timing sequence of the clock signals.

8. A device for driving a display panel, comprising:

an acquisition circuit, configured to acquire a gate driver on array (GOA) signal corresponding to a current frame of image, wherein the GOA signal comprises a plurality of clock signals;

a transmission channel determination circuit, configured to determine a transmission channel corresponding to each of the plurality of clock signals, and generate a correspondence relationship between the clock signals and respective transmission channels, wherein the transmission channels are used to deliver the clock signals from a GOA control signal generator to a GOA circuit of the display panel, the current frame of image is different from at least one frame of image previous to the current frame of image with respect to the correspondence relationship between the clock signals and respective transmission channels; and a transmission circuit, configured to transmit the clock signals by using the determined transmission channels, wherein the transmission channel determination circuit is configured to generate a random number corresponding to each frame of image, and determine the transmission channel corresponding to each of the plurality of clock signals based on the generated random number, and generate the correspondence relationship between the clock signals and respective transmission channels.

9. The device for driving the display panel according to claim 8, wherein both a quantity of the transmission channels and a quantity of the clock signals are M, M is a positive integer, and the transmission channel determination circuit comprises:

a random number generation sub-circuit, configured to generate a random number N corresponding to the current frame of image, wherein N is a positive integer and is not greater than M; and a transmission channel determination sub-circuit, configured to determine that a Kth clock signal corresponds to a (K+N−1)th transmission channel in a case that K+N−1 is not greater than M, wherein K is a positive integer and is less than or equal to M; and configured to determine that a Kth clock signal corresponds to a (K+N−1−M)th transmission channel in a case that K+N−1 is greater than M.

10. The device for driving the display panel according to claim 8, wherein both a quantity of the transmission channels and a quantity of the clock signals are M, M is a positive integer, and the transmission channel determination circuit comprises:

a random number generation sub-circuit, configured to generate a random number N corresponding to the current frame of image, wherein N is a positive integer and N is not greater than M; and a transmission channel determination sub-circuit, configured to determine that a Kth transmission channel corresponds to a (K+N−1)th clock signal in a case that K+N−1 is not greater than M, wherein K is a positive integer and is less than or equal to M; and configured to determine that a Kth transmission channel corresponds to a (K+N−1−M)th clock signal in a case that K+N−1 is greater than M.

11. The device for driving the display panel according to claim 8, wherein both a quantity of the transmission channels and a quantity of the clock signals are M, M is a positive integer, and the transmission channel determination circuit comprises:

a random number generation sub-circuit, configured to generate a randomly arranged sequence comprising M random numbers that corresponds to the current frame of image; and a transmission channel determination sub-circuit, configured to take the randomly arranged sequence as a first arrangement sequence corresponding to M clock signals, wherein M transmission channels are arranged sequentially; and configured to determine the transmission channel corresponding to each of the M clock signals based on the first arrangement sequence and the M transmission channels arranged sequentially, and generate the correspondence relationship between the clock signals and respective transmission channels.

12. The device for driving the display panel according to claim 8, wherein both a quantity of the transmission channels and a quantity of the clock signals are M, M is a positive integer, and the transmission channel determination circuit comprises:

a random number generation sub-circuit, configured to generate a randomly arranged sequence comprising M random numbers that corresponds to the current frame of image; and a transmission channel determination sub-circuit, configured to take the randomly arranged sequence as a second arrangement sequence corresponding to M transmission channels, wherein M clock signals are arranged sequentially; and configured to determine the transmission channel corresponding to each of the M clock signals based on the second arrangement sequence and the M clock signals arranged sequentially, and generate the correspondence relationship between the clock signals and respective transmission channels.

13. The device for driving the display panel according to claim 8, further comprising:

a timing sequence adjustment circuit, configured to adjust a transmission timing sequence of data signals so that the transmission timing sequence of the data signals matches a timing sequence of the clock signals, wherein the timing sequence of the clock signals is determined based on the correspondence relationship between the clock signals and respective transmission channels.

14. The device for driving the display panel according to claim 13, wherein the timing sequence adjustment circuit comprises:

a group division sub-circuit, configured to divide the data signals into a plurality of groups according to a quantity of the clock signals in sequence, wherein a quantity of data signals in each of the plurality of groups is equal to the quantity of the clock signals; and an adjustment sub-circuit, configured to adjust a timing sequence of the data signals in each of the plurality of groups so that the timing sequence of the data signals in each of the plurality of groups matches the timing sequence of the clock signals.

15. A display device comprising a display panel and the device for driving the display panel according to claim 8.

16. A device for driving a display panel, comprising a memory and an executor, wherein the executor is configured to execute following instructions stored in the memory:

acquiring a gate driver on array (GOA) signal corresponding to a current frame of image, wherein the GOA signal comprises a plurality of clock signals;

determining a transmission channel corresponding to each of the plurality of clock signals, and generating a correspondence relationship between the clock signals and respective transmission channels, wherein the transmission channels are used to deliver the clock signals from a GOA control signal generator to a GOA circuit of the display panel, and the current frame of image is different from at least one frame of image previous to the current frame of image with respect to the correspondence relationship between the clock signals and respective transmission channels; and transmitting the clock signals by using the determined transmission channels, wherein the executor is further configured to execute the following instructions stored in the memory generating a random number corresponding to each frame of image, and determining a transmission channel corresponding to each of the plurality of clock signals based on the generated random number, and generating the correspondence relationship between the clock signals and respective transmission channels.

17. A display device comprising a display panel and the device for driving the display panel according to claim 16.

* * * * *